US008270626B2

(12) United States Patent
Shridhar et al.

(10) Patent No.: US 8,270,626 B2
(45) Date of Patent: Sep. 18, 2012

(54) SYSTEM FOR ACTIVE NOISE CONTROL WITH AUDIO SIGNAL COMPENSATION

(75) Inventors: Vasant Shridhar, Royal Oak, MI (US); Duane Wertz, Byron, MI (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 13/419,420

(22) Filed: Mar. 13, 2012

(65) Prior Publication Data

US 2012/0170764 A1 Jul. 5, 2012

Related U.S. Application Data

(63) Continuation of application No. 12/275,118, filed on Nov. 20, 2008, now Pat. No. 8,135,140, and a continuation of application No. 13/418,095, filed on Mar. 12, 2010.

(51) Int. Cl.
*G10K 11/36* (2006.01)

(52) U.S. Cl. ..... 381/71.14; 341/110

(58) Field of Classification Search ..... 381/71.14; 341/110; 455/103, 114.1–114.3
See application file for complete search history.

(56) References Cited

U.S. PATENT DOCUMENTS

| | | | | |
|---|---|---|---|---|
| 4,589,137 | A | 5/1986 | Miller | 381/94 |
| 4,628,156 | A | 12/1986 | Irvin | 379/410 |
| 4,654,871 | A | 3/1987 | Chaplin et al. | 381/71 |
| 4,677,678 | A | 6/1987 | McCutchen | 381/72 |
| 4,910,799 | A | 3/1990 | Takayama | 455/296 |
| 4,941,187 | A | 7/1990 | Slater | 381/86 |
| 4,947,356 | A | 8/1990 | Elliott et al. | 364/574 |
| 4,953,217 | A | 8/1990 | Twiney et al. | 381/72 |
| 4,977,600 | A | 12/1990 | Ziegler | 381/71 |
| 4,985,925 | A | 1/1991 | Langberg et al. | 381/72 |
| 4,998,241 | A | 3/1991 | Brox et al. | 370/32.1 |
| 5,001,763 | A | 3/1991 | Moseley | 381/71 |
| 5,033,082 | A | 7/1991 | Eriksson et al. | 379/410 |
| 5,091,954 | A | 2/1992 | Sasaki et al. | 381/72 |

(Continued)

FOREIGN PATENT DOCUMENTS

CN 1688179 A 10/2005

(Continued)

OTHER PUBLICATIONS

U.S. Appl. No. 13/418,095, filed Mar. 12, 2012.

(Continued)

*Primary Examiner* — Henry Choe
(74) *Attorney, Agent, or Firm* — Brinks Hofer Gilson & Lione

(57) ABSTRACT

An active noise control system generates an anti-noise signal to drive a speaker to produce sound waves to destructively interfere with an undesired sound in a targeted space. The speaker is also driven to produce sound waves representative of a desired audio signal. Sound waves are detected in the target space and a representative signal is generated. The representative signal is combined with an audio compensation signal to remove a signal component representative of the sound waves based on the desired audio signal and generate an error signal. The active noise control adjusts the anti-noise signal based on the error signal. The active noise control system converts the sample rates of an input signal representative of the undesired sound, the desired audio signal, and the error signal. The active noise control system converts the sample rate of the anti-noise signal.

20 Claims, 10 Drawing Sheets

U.S. PATENT DOCUMENTS 5,105,377 A 4/1992 Ziegler, Jr. ..... 364/724.01
5,133,017 A 7/1992 Cain et al. ..... 381/71
5,138,664 A 8/1992 Kimura et al. ..... 381/72
5,170,433 A 12/1992 Elliott et al. ..... 381/47
5,182,774 A 1/1993 Bourk ..... 381/71
5,208,868 A 5/1993 Sapiejewski ..... 381/183
5,251,262 A 10/1993 Suzuki et al. ..... 381/71
5,276,740 A 1/1994 Inanaga et al. ..... 381/187
5,289,147 A 2/1994 Koike et al. ..... 355/200
5,305,387 A 4/1994 Sapiejewski ..... 381/71
5,337,366 A 8/1994 Eguchi et al. ..... 381/71
5,371,802 A 12/1994 McDonald et al. ..... 381/71
5,377,276 A 12/1994 Terai et al. ..... 381/71
5,381,473 A 1/1995 Andrea et al. ..... 379/387
5,381,485 A 1/1995 Elliott ..... 381/71
5,400,409 A 3/1995 Linhard ..... 381/92
5,425,105 A 6/1995 Lo et al. ..... 381/71
5,427,102 A 6/1995 Shimode et al. ..... 128/653.2
5,485,523 A 1/1996 Tamamura et al. ..... 381/71
5,488,667 A 1/1996 Tamamura et al. ..... 387/71
5,492,129 A 2/1996 Greenberger ..... 128/715
5,493,616 A 2/1996 Iidaka et al. ..... 381/71
5,497,426 A 3/1996 Jay ..... 381/67
5,499,302 A 3/1996 Nagami et al. ..... 381/71
5,526,421 A 6/1996 Berger et al. ..... 379/389
5,559,893 A 9/1996 Krokstad et al. ..... 381/71
5,586,189 A 12/1996 Allie et al. ..... 381/71
5,602,927 A 2/1997 Tamamura et al. ..... 381/71
5,602,928 A 2/1997 Eriksson et al. ..... 381/71
5,604,813 A 2/1997 Evans et al. ..... 381/71
5,621,803 A 4/1997 Laak ..... 381/71
5,673,325 A 9/1997 Andrea et al. ..... 381/92
5,675,658 A 10/1997 Brittain ..... 381/72
5,680,337 A 10/1997 Pedersen et al. ..... 364/724.19
5,687,075 A 11/1997 Stothers ..... 364/148
5,689,572 A 11/1997 Ohki et al. ..... 381/71.3
5,691,893 A 11/1997 Stothers ..... 364/148
5,692,059 A 11/1997 Kruger ..... 381/151
5,699,437 A 12/1997 Finn ..... 381/71
5,706,344 A 1/1998 Finn ..... 379/410
5,715,320 A 2/1998 Allie et al. ..... 381/71.12
5,727,066 A 3/1998 Elliott et al. ..... 381/1
5,737,433 A 4/1998 Gardner ..... 381/94.7
5,740,257 A 4/1998 Marcus ..... 381/71.6
5,745,396 A 4/1998 Shanbhag ..... 364/724.19
5,768,124 A 6/1998 Stothers et al. ..... 364/158
5,774,564 A 6/1998 Eguchi et al. ..... 381/71.11
5,774,565 A 6/1998 Benning et al. ..... 381/83
5,809,156 A 9/1998 Bartels et al. ..... 381/183
5,815,582 A 9/1998 Claybaugh et al. ..... 381/71.6
5,872,728 A 2/1999 Richter ..... 364/724.2
5,937,070 A 8/1999 Todter et al. ..... 381/71.6
6,069,959 A 5/2000 Jones ..... 381/71.6
6,078,672 A 6/2000 Saunders et al. ..... 381/71.6
6,163,610 A 12/2000 Bartlett et al. ..... 379/433
6,166,573 A 12/2000 Moore et al. ..... 327/161
6,181,801 B1 1/2001 Puthuff et al. ..... 381/380
6,185,299 B1 2/2001 Goldin ..... 379/406
6,278,785 B1 8/2001 Thomasson ..... 381/66
6,295,364 B1 9/2001 Finn et al. ..... 381/110
6,301,364 B1 10/2001 Lowmiller et al. ..... 381/66
6,343,127 B1 1/2002 Billoud ..... 381/71.4
6,347,146 B1 2/2002 Short et al. ..... 381/15
6,377,680 B1 4/2002 Foladare et al. ..... 379/392.01
6,421,443 B1 7/2002 Moore et al. ..... 379/406.01
6,445,799 B1 9/2002 Taenzer et al. ..... 381/71.6
6,445,805 B1 9/2002 Grugel ..... 381/330
6,466,673 B1 10/2002 Hardy
6,496,581 B1 12/2002 Finn et al. ..... 379/406.01
6,505,057 B1 1/2003 Finn et al. ..... 455/569
6,529,605 B1 3/2003 Christoph ..... 381/56
6,532,289 B1 3/2003 Magid ..... 379/406.01
6,532,296 B1 3/2003 Vaudrey et al. ..... 381/371
6,567,524 B1 5/2003 Svean et al. ..... 381/71.1
6,567,525 B1 5/2003 Sapiejewski ..... 381/71.6
6,597,792 B1 7/2003 Sapiejewski et al. ..... 381/71.6
6,625,286 B1 9/2003 Rubacha et al. ..... 381/93
6,633,894 B1 10/2003 Cole ..... 708/300
6,643,619 B1 11/2003 Linhard et al. ..... 704/233
6,665,410 B1 12/2003 Parkins ..... 381/71.1
6,687,669 B1 2/2004 Schrogmeier et al. ..... 704/226
6,690,800 B2 2/2004 Resnick ..... 381/73.1
6,798,881 B2 9/2004 Thomasson ..... 379/406.07
6,845,162 B1 * 1/2005 Emborg et al. ..... 381/71.4
6,991,289 B2 1/2006 House ..... 297/217.4
7,020,288 B1 3/2006 Ohashi ..... 381/71.4
7,062,049 B1 6/2006 Inoue et al. ..... 381/71.4
7,103,188 B1 9/2006 Jones ..... 381/71.9
7,133,529 B2 11/2006 Ura ..... 381/66
7,333,618 B2 2/2008 Shuttleworth et al. ..... 381/57
7,440,578 B2 10/2008 Arai et al. ..... 381/302
7,469,051 B2 12/2008 Sapashe et al. ..... 381/104
7,536,018 B2 5/2009 Onishi et al. ..... 381/71.8
7,574,006 B2 8/2009 Funayama et al. ..... 381/71.12
7,627,352 B2 12/2009 Gauger, Jr. et al. ..... 455/569.1
7,630,432 B2 12/2009 Hofmeister ..... 375/232
7,773,760 B2 8/2010 Sakamoto et al. ..... 381/71.9
7,808,395 B2 10/2010 Raisanen et al. ..... 340/667
7,873,173 B2 * 1/2011 Inoue et al. ..... 381/71.4
7,885,417 B2 2/2011 Christoph ..... 381/71.11
7,933,420 B2 4/2011 Copley et al. ..... 381/71.11
8,027,484 B2 9/2011 Yoshida et al. ..... 381/71.4
2001/0036283 A1 11/2001 Donaldson ..... 381/71.11
2002/0068617 A1 6/2002 Han
2002/0076059 A1 6/2002 Joynes ..... 381/71.6
2002/0138263 A1 9/2002 Deligne et al. ..... 704/233
2002/0143528 A1 10/2002 Deligne et al. ..... 704/224
2002/0172374 A1 11/2002 Bizjak ..... 381/71.14
2002/0176589 A1 11/2002 Buck et al. ..... 381/94.7
2003/0035551 A1 2/2003 Light et al. ..... 381/71.6
2003/0103636 A1 6/2003 Arai et al. ..... 381/302
2003/0142841 A1 7/2003 Wiegand ..... 381/172
2003/0228019 A1 12/2003 Eichler et al. ..... 381/71.8
2004/0037429 A1 2/2004 Candioty ..... 381/67
2004/0076302 A1 4/2004 Christoph ..... 381/57
2005/0175187 A1 8/2005 Wright et al. ..... 381/71.12
2005/0207585 A1 9/2005 Christoph ..... 381/71.11
2005/0226434 A1 10/2005 Franz et al. ..... 381/71.7
2005/0232435 A1 10/2005 Stothers et al. ..... 381/71.11
2006/0098809 A1 5/2006 Nongpiur et al. ..... 379/406.14
2006/0153394 A1 7/2006 Beasley ..... 381/57
2006/0251266 A1 11/2006 Saunders et al. ..... 381/71.1
2006/0262935 A1 11/2006 Goose et al. ..... 381/17
2007/0053532 A1 3/2007 Elliott et al. ..... 381/302
2007/0098119 A1 5/2007 Stothers et al. ..... 375/345
2007/0253567 A1 11/2007 Sapiejewski ..... 381/71.6
2008/0095383 A1 4/2008 Pan et al. ..... 381/71.11
2008/0181422 A1 7/2008 Christoph ..... 381/73.1
2008/0192948 A1 8/2008 Kan et al. ..... 381/71.4
2008/0247560 A1 10/2008 Fukuda et al. ..... 381/71.6
2009/0067638 A1 * 3/2009 Sakamoto et al. ..... 381/71.4
2009/0086990 A1 4/2009 Christoph ..... 381/71.12
2009/0086995 A1 4/2009 Christoph et al. ..... 381/103
2009/0220102 A1 9/2009 Pan et al. ..... 381/71.11
2010/0014685 A1 1/2010 Wurm ..... 381/71.11
2010/0061566 A1 3/2010 Moon et al. ..... 381/71.8
2010/0098263 A1 4/2010 Pan et al. ..... 381/71.11
2010/0098265 A1 4/2010 Pan et al. ..... 381/94.1
2010/0124337 A1 5/2010 Wertz et al. ..... 381/71.11
2010/0177905 A1 7/2010 Shridhar et al. ..... 381/71.11
2010/0226505 A1 9/2010 Kimura ..... 381/71.6
2010/0239105 A1 9/2010 Pan ..... 381/94.9
2010/0260345 A1 10/2010 Shridhar et al. ..... 381/71.1
2010/0266134 A1 10/2010 Wertz et al. ..... 381/71.1
2010/0266137 A1 10/2010 Sibbald et al. ..... 381/71.6
2010/0272275 A1 10/2010 Carreras et al. ..... 381/71.6
2010/0272280 A1 10/2010 Joho et al. ..... 381/71.6
2010/0272281 A1 10/2010 Carreras et al. ..... 381/71.6
2010/0274564 A1 10/2010 Bakalos et al. ..... 704/500
2010/0290635 A1 11/2010 Shridhar et al. ..... 381/71.1
2010/0296669 A1 11/2010 Oh et al. ..... 381/109
2011/0116643 A1 5/2011 Tiscareno et al. ..... 381/58

FOREIGN PATENT DOCUMENTS

EP 0 622 779 A2 11/1994
EP 0 539 940 B1 4/1996
EP 0 572 492 B1 11/1997

| | | | |
|---|---|---|---|
| EP | 1 653 445 | A1 | 5/2006 |
| EP | 1 577 879 | B1 | 7/2008 |
| EP | 1 947 642 | A1 | 7/2008 |
| GB | 2 293 898 | B | 4/1996 |
| JP | 61-112496 | | 5/1986 |
| JP | 06-318085 | | 11/1994 |
| JP | 06-332474 | | 12/1994 |
| JP | 07-056583 | | 3/1995 |
| JP | 08-095579 | | 4/1996 |
| JP | 10-207470 | | 8/1998 |
| JP | 11 259078 | A | 9/1999 |
| JP | 2006-126841 | | 5/2006 |
| JP | 2007-253799 | | 10/2007 |
| WO | WO 90/09655 | | 8/1990 |
| WO | WO 94/09480 | | 4/1994 |
| WO | WO 94/09481 | | 4/1994 |
| WO | WO 94/09482 | | 4/1994 |
| WO | WO 95/26521 | | 10/1995 |
| WO | WO 96/10780 | | 4/1996 |

OTHER PUBLICATIONS

Extended European Search Report from European Application No. EP 10150426.4-2213, dated May 26, 2010, 7 pgs.
Martins C R et al., "Fast Adaptive Noise Canceller Using the LMS Algorithm", Proceedings of the International Conference on Signal Processing Applications and Technology, vol. 1, Sep. 28, 1993, 8 pgs.
European Search Report from European Application No. EP 10162225 dated Oct. 1, 2010, 5 pgs.
Gonzalez, A. et al., "Minimisation of the maximum error signal in active control", IEEE International Conference on Acoustics, Speech, and Signal Processing, 1997, 4 pgs.
Gao, F. X. Y. et al., "An Adaptive Backpropagation Cascade IIR Filter," *IEEE*, vol. 39, No. 9, 1992, pp. 606-610.
Kuo, S. M. et al., "Active Noise Control Systems: Algorithms and DSP Implementations," John Wiley & Sons, Inc., New York, NY, Copyright 1996, 411 pgs.
Colin H. Hansen et al., "Active Control of Noise and Vibration," E & FN Spon., London SE1, Copyright 1997, pp. 642-652.
Office Action, dated Aug. 26, 2011, pp. 1-24, U.S. Appl. No. 12/421,459, U.S. Patent and Trademark Office, Virginia.
Office Action, dated Aug. 3, 2011, pp. 1-33, U.S. Appl. No. 12/352,435, U.S. Patent and Trademark Office, Virginia.
Office Action, dated Aug. 17, 2011, pp. 1-26, U.S. Appl. No. 12/425,997, U.S. Patent and Trademark Office, Virginia.
Office Action, dated Sep. 13, 2011, pp. 1-16, U.S. Appl. No. 12/420,658, U.S. Patent and Trademark Office, Virginia.
Notice of Allowance, dated Aug. 15, 2011, pp. 1-14, U.S. Appl. No. 12/466,282, U.S. Patent and Trademark Office, Virginia.
Notice of Allowance, dated Nov. 2, 2011, pp. 1-9, U.S. Appl. No. 12/275,118, U.S. Patent and Trademark Office, Virginia.
Chinese Office Action, dated Jun. 12, 2011, pp. 1-11, Chinese Patent Application No. 200910226444.6, Chinese Patent Office, China.
Chen, Kean et al., Adaptive Active Noise Elimination and Filter-XLMS Algorithm, 1993, pp.27-33, vol. 12 (4), Applied Acoustics, and translation of Abstract (8 pgs.).
Japanese Office Action dated Nov. 4, 2011, Japanese Patent Application No. 2009-260242, pp. 1-9, Japanese Patent Office, Japan.
Notice of Allowance, dated Jan. 13, 2012, U.S. Appl. No. 12/425,997, U.S. Patent and Trademark Office, Virginia.
Notice of Allowance, dated Feb. 2, 2012, U.S. Appl. No. 12/421,459, U.S. Patent and Trademark Office, Virginia.
Office Action, dated Mar. 7, 2012, pp. 1-13, U.S. Appl. No. 12/420,658, U.S. Patent and Trademark Office, Virginia.
Office Action, dated Feb. 14, 2012, pp. 1-36, U.S. Appl. No. 12/352,435, U.S. Patent and Trademark Office, Virginia.
Chinese Office Action, dated Feb. 24, 2012, Chinese Patent Application No. 200910226444.6, Chinese Patent Office, China.
Notice of Allowance, dated Jul. 16, 2012, pp. 1-14, U.S. Appl. No. 13/418,095 U.S. Patent and Trademark Office, Virginia.
Office Action, dated May 25, 2012, pp. 1-12, U.S. Appl. No. 12/420,658, U.S. Patent and Trademark Office, Virginia.

* cited by examiner

SYSTEM FOR ACTIVE NOISE CONTROL WITH AUDIO SIGNAL COMPENSATION

This application is a continuation application of, and claims priority under 35 U.S.C. §120 to, U.S. patent application Ser. No. 12/275,118, "SYSTEM FOR ACTIVE NOISE CONTROL WITH AUDIO SIGNAL COMPENSATION" filed Nov. 20, 2008, and is a continuation application of, and claims priority under 35 U.S.C. §120 to, U.S. patent application Ser. No. 13/418,095, "SYSTEM FOR ACTIVE NOISE CONTROL WITH AUDIO SIGNAL COMPENSATION" filed Mar. 12, 2012, both of which are incorporated by reference.

BACKGROUND OF THE INVENTION

1. Technical Field

This invention relates to active noise control, and more specifically to active noise control used with an audio system.

2. Related Art

Active noise control may be used to generate sound waves that destructively interfere with a targeted sound. The destructively interfering sound waves may be produced through a loudspeaker to combine with the targeted sound. Active noise control may be desired in a situation in which audio sound waves, such as music, may be desired as well. An audio/visual system may include various loudspeakers to generate audio. These loudspeakers may be simultaneously used to produce destructively interfering sound waves.

An active noise control system generally includes a microphone to detect sound proximate to an area targeted for destructive interference. The detected sound provides an error signal in which to adjust the destructively interfering sound waves. However, if audio is also generated through a common loudspeaker, the microphone may detect the audio sound waves, which may be included in the error signal. Thus, the active noise control may track sounds not desired to be interfered with, such as the audio. This may lead to inaccurately generated destructive interference. Furthermore, the active noise control system may generate sound waves to destructively interfere with the audio. Therefore, a need exists to remove an audio component from an error signal in an active noise control system.

SUMMARY

An active noise control (ANC) system may generate an anti-noise signal to drive a speaker to generate sound waves to destructively interfere with an undesired sound present in a target space. The ANC system may generate an anti-noise based on an input signal representative of the undesired sound. The speaker may also be driven to generate sound waves representative of a desired audio signal. A microphone may receive sound waves present in the target space and generate a representative signal. The representative signal may be combined with an audio compensation signal to remove a component representative of the sound waves based on the desired audio signal to generate an error signal. The audio compensation signal may be generated through filtering an audio signal with an estimated path filter. The error signal may be received by the ANC system to adjust the anti-noise signal.

An ANC system may be configured to receive an input signal indicative of an undesired sound having a first sample rate and convert the first sample rate to a second sample rate. The ANC system may also be configured to receive an audio signal having a third sample rate and converting the third sample rate to the second sample rate. The ANC system may also be configured to receive an error signal having the first sample rate and converting the first sample rate to the second sample rate. The ANC system may generate an anti-noise signal at the second sample rate based on the input signal, the audio signal, and the error signal at the second sample. The sample rate of the anti-noise signal may be converted from the second sample rate to the first sample rate.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

The present disclosure provides a system configured to generate a destructively interfering sound wave with audio compensation. This is accomplished generally by first determining the presence of an undesired sound and generating a destructively interfering sound wave. A destructively interfering signal may be included as part of a speaker output along with an audio signal. A microphone may receive the undesired sound and sound waves from a loudspeaker driven with the speaker output. The microphone may generate an input signal based on the received sound waves. A component related to the audio signal may be removed from the input signal prior to generating an error signal. The error signal may be used to more accurately generate the destructively interfering signal that produces the destructively interfering sound wave.

Figure 1:
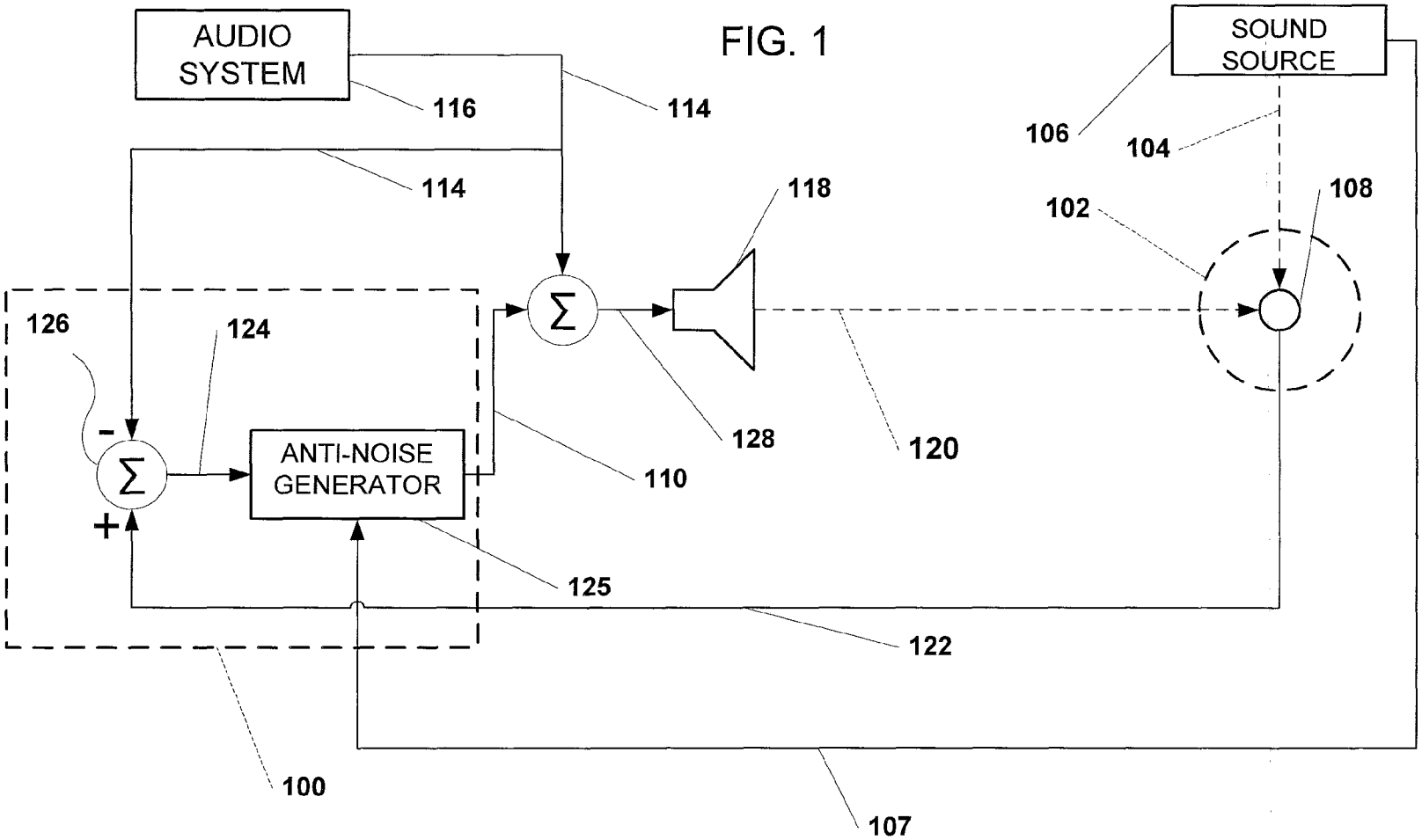
FIG. 1 depicts a diagrammatic view of an example active noise cancellation (ANC) system.

In FIG. 1, an example of an active noise control (ANC) system 100 is diagrammatically shown. The ANC system 100 may be implemented in various settings, such as a vehicle interior, to reduce or eliminate a particular sound frequencies or frequency ranges from being audible in a target space 102. The example ANC system 100 of FIG. 1 is configured to generate signals at one or more desired frequencies or frequency ranges that may be generated as sound waves to destructively interfere with undesired sound 104, represented by a dashed-arrow in FIG. 1, originating from a sound source 106. In one example, the ANC system 100 may be configured to destructively interfere with undesired sound within a frequency range of approximately 20-500 Hz. The ANC system 100 may receive a sound signal 107 indicative of sound emanating from the sound source 106 that is audible in the target space 102.

A sensor such as a microphone 108 may be placed in the target space 102. The ANC system 100 may generate an anti-noise signal 110, which in one example may be representative of sound waves of approximately equal amplitude and frequency that are approximately 180 degrees out of phase with the undesired sound 104 present in the target space 102. The 180 degree phase shift of the anti-noise signal may cause desirable destructive interference with the undesired sound in an area in which the anti-noise sound waves and the undesired sound 104 sound waves destructively combine.

In FIG. 1, the anti-noise signal 110 is shown as being summed at summation operation 112 with an audio signal 114, generated by an audio system 116. The combined anti-noise signal 110 and audio signal 114 are provided to drive a speaker 118 to produce a speaker output 120. The speaker output 120 is an audible sound wave that may be projected towards the microphone 108 within the target space 102. The anti-noise signal 110 component of the sound wave produced as the speaker output 120 may destructively interfere with the undesired sound 104 within the target space 102.

The microphone 108 may generate a microphone input signal 122 based on detection of the combination of the speaker output 120 and the undesired noise 104, as well as other audible signals within range of being received by the microphone 108. The microphone input signal 122 may be used as an error signal in order to adjust the anti-noise signal 110. The microphone input signal 122 may include a component representative of any audible signal received by the microphone 108 that is remaining from the combination of the anti-noise 110 and the undesired noise 104. The microphone input signal 122 may also contain a component representative of any audible portion of the speaker output 120 resulting from output of a sound wave representative of the audio signal 114. The component representative of the audio signal 114 may be removed from the microphone input signal 108 allowing the anti-noise signal 110 to be generated based upon an error signal 124. The ANC system 100 may remove a component representative of the audio signal 114 from the microphone input signal 122 at summation operation 126, which, in one example, may be performed by inverting the audio signal 114 and adding it to the microphone input signal 122. The result is the error signal 124, which is provided as input to an anti-noise generator 125 of the ANC system 100. The anti-noise generator 125 may produce the anti-noise signal 110 based on the error signal 124 and the sound signal 107.

The ANC system 100 may allow the anti-noise signal 110 to be dynamically adjusted based on the error signal 124 and the sound signal 107 to more accurately produce the anti-noise signal 110 to destructively interfere with the undesired sound 104 within the targeted space 102. The removal of a component representative of the audio signal 114 may allow the error signal 124 to more accurately reflect any differences between the anti-noise signal 110 and the undesired sound 104. Allowing a component representative of the audio signal 114 to remain included in the error signal input to the anti-noise generator 125 may cause the anti-noise generator 125 to generate an anti-noise signal 110 that includes a signal component to destructively combine with the audio signal 114. Thus, the ANC system 100 may also cancel or reduce sounds associated with the audio system 116, which may be undesired. Also, the anti-noise signal 110 may be undesirably altered such that any generated anti-noise is not accurately tracking the undesired noise 104 due to the audio signal 114 being included. Thus, removal of a component representative of the audio signal 114 to generate the error signal 124 may enhance the fidelity of the audio sound generated by the speaker 118 from the audio signal 114, as well as more efficiently reduce or eliminate the undesired sound 104.

Figure 2:
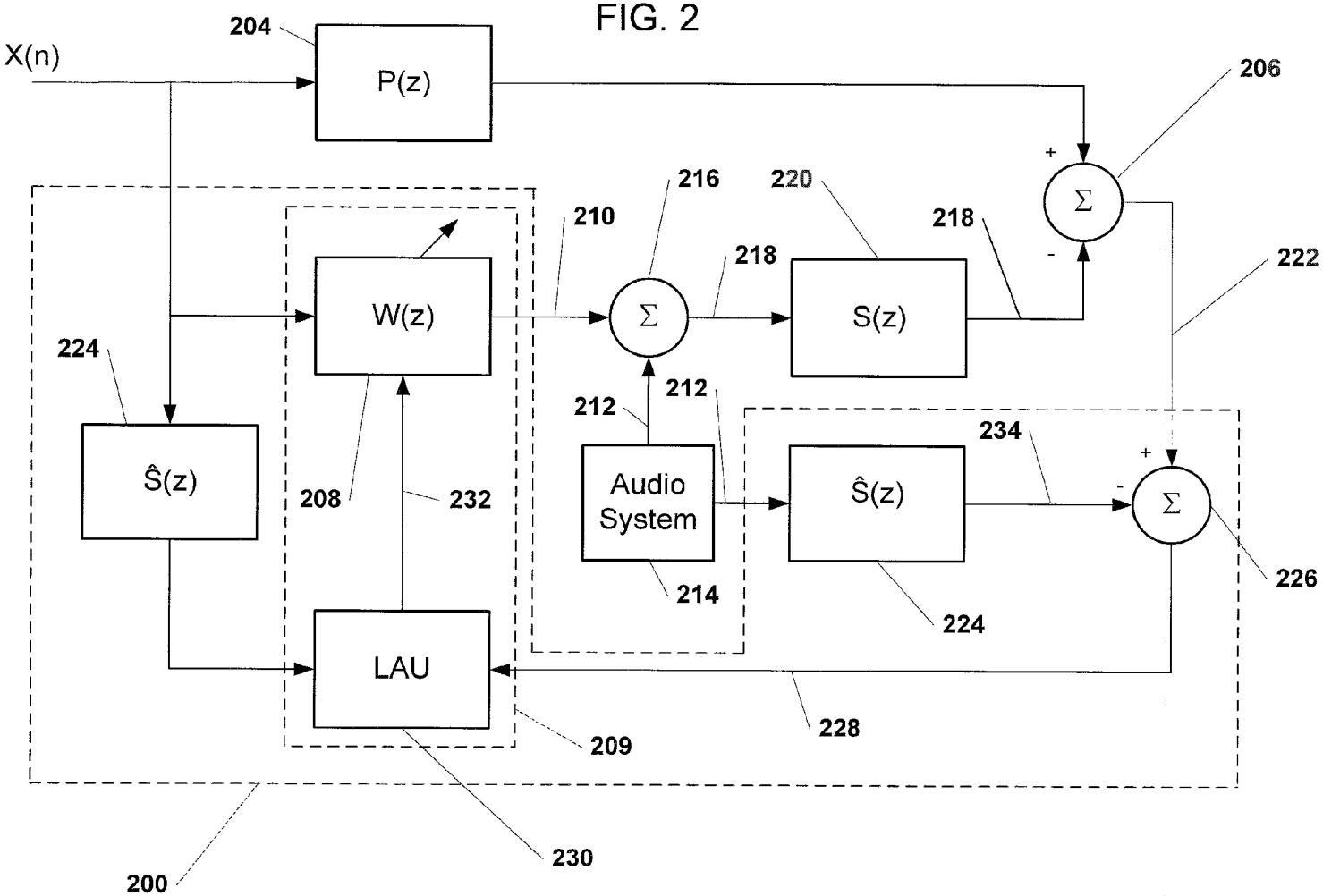
FIG. 2 depicts a block diagram of an example configuration implementing an ANC system.

In FIG. 2, an example ANC system 200 and an example physical environment are represented through a block diagram format. The ANC system 200 may operate in a manner similar to the ANC system 100 as described with regard to FIG. 1. In one example, an undesired sound x(n) may traverse a physical path 204 from a source of the undesired sound x(n) to a microphone 206. The physical path 204 may be represented by a z-domain transfer function P(z). In FIG. 2, the undesired sound x(n) represents the undesired sound both physically and a digital representation that may be produced through use of an analog-to-digital (A/D) converter. The undesired sound x(n) may also be used as an input to an adaptive filter 208, which may be included in an anti-noise generator 209. The adaptive filter 208 may be represented by a z-domain transfer function W(z). The adaptive filter 208 may be a digital filter configured to be dynamically adapted in order to filter an input to produce a desired anti-noise signal 210 as an output.

Similar to that described in FIG. 1, the anti-noise signal 210 and an audio signal 212 generated by an audio system 214 may be combined to drive a speaker 216. The combination of the anti-noise signal 210 and the audio signal 212 may produce the sound wave output from the speaker 216. The speaker 216 is represented by a summation operation in FIG. 2. having a speaker output 218. The speaker output 218 may be a sound wave that travels a physical path 220 that includes a path from the speaker 216 to the microphone 206. The physical path 220 may be represented in FIG. 2 by a z-domain transfer function S(z). The speaker output 218 and the undesired noise x(n) may be received by the microphone 206 and a microphone input signal 222 may be generated by the microphone 206. In other examples, any number of speaker and microphones may be present.

As similarly discussed in regard to FIG. 1, a component representative of the audio signal 212 may be removed from the microphone input signal 222, through processing of the microphone input signal 222. In FIG. 2, the audio signal 212 may be processed to reflect the traversal of the physical path 220 by the sound wave of the audio signal 212. This processing may be performed by estimating the physical path 220 as an estimated path filter 224, which provides an estimated effect on an audio signal sound wave traversing the physical path 220. The estimated path filter 224 is configured to simulate the effect on the sound wave of the audio signal 212 of traveling through the physical path 220 and generate an output signal 234. In FIG. 2, the estimated path filter 224 may be represented as a z-domain transfer function $\hat{S}(z)$.

The microphone input signal 222 may be processed such that a component representative of the audio signal 234 is removed as indicated by a summation operation 226. This may occur by inverting the filtered audio signal at the summation operation 226 and adding the inverted signal to the microphone input signal 222.

Alternatively, the filtered audio signal could be subtracted or any other mechanism or method to remove. The output of the summation operation 226 is an error signal 228, which may represent an audible signal remaining after any destructive interference between the anti-noise signal 210 projected through the speaker 216 and the undesired noise x(n). The summation operation 226 removing a component representative of the audio signal 234 from the input signal 222 may be considered as being included in the ANC system 200.

The error signal 228 is transmitted to a learning algorithm unit (LAU) 230, which may be included in the anti-noise generator. The LAU 230 may implement various learning algorithms, such as least mean squares (LMS), recursive least mean squares (RLMS), normalized least mean squares (NLMS), or any other suitable learning algorithm. The LAU 230 also receives as an input the undesired noise x(n) filtered by the filter 224. LAU output 232 may be an update signal transmitted to the adaptive filter 208. Thus, the adaptive filter 208 is configured to receive the undesired noise x(n) and the LAU output 232. The LAU output 232 is transmitted to the adaptive filter 208 in order to more accurately cancel the undesired noise x(n) by providing the anti-noise signal 210.

Figure 3:
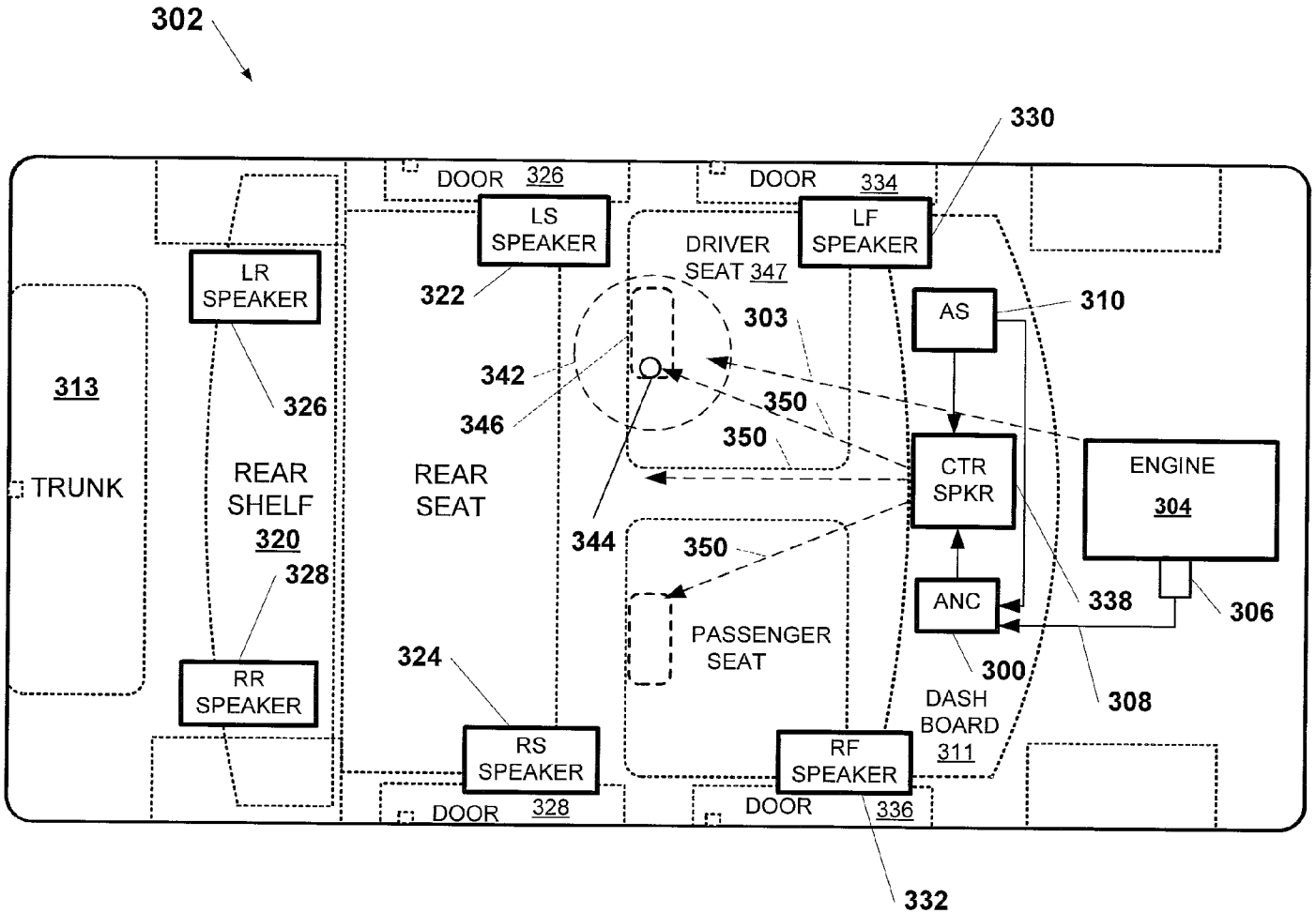
FIG. 3 depicts illustrates a top view of an example vehicle implementing an ANC system.

In FIG. 3, an example ANC system 300 may be implemented in an example vehicle 302. In one example, the ANC system 300 may be configured to reduce or eliminate undesired sounds associated with the vehicle 302. In one example, the undesired sound may be engine noise 303 (represented in FIG. 3 as a dashed arrow) associated with an engine 304. However, various undesired sounds may be targeted for reduction or elimination such as road noise or any other undesired sound associated with the vehicle 302. The engine noise 303 may be detected through at least one sensor 306. In one example, the sensor 306 may be an accelerometer, which may generate an engine noise signal 308 based on a current operating condition of the engine 304 indicative of the level of the engine noise 303. Other manners of sound detection may be implemented, such as microphones or any other sensors suitable to detect audible sounds associated with the vehicle 302. The signal 308 may be transmitted to the ANC system 300.

The vehicle 302 may contain various audio/video components. In FIG. 3, the vehicle 302 is shown as including an audio system 310, which may include various devices for providing audio/visual information, such as an AM/FM radio, CD/DVD player, mobile phone, navigation system, MP3 player, or personal music player interface. The audio system 310 may be embedded in the dash board 311. The audio system 310 may also be configured for mono, stereo, 5-channel, and 7-channel operation, or any other audio output configuration. The audio system 310 may include a plurality of speakers in the vehicle 302. The audio system 310 may also include other components, such as an amplifier (not shown), which may be disposed at various locations within the vehicle 302 such as the trunk 313.

In one example, the vehicle 302 may include a plurality of speakers, such as a left rear speaker 326 and a right rear speaker 328, which may be positioned on or within a rear shelf 320. The vehicle 302 may also include a left side speaker 322 and a right side speaker 324, each mounted within a vehicle door 326 and 328, respectively. The vehicle may also include a left front speaker 330 and a right front speaker 332, each mounted within a vehicle door 334, 336, respectively. The vehicle may also include a center speaker 338 positioned within the dashboard 311. In other examples, other configurations of the audio system 310 in the vehicle 302 are possible.

In one example, the center speaker 338 may be used to transmit anti-noise to reduce engine noise that may be heard in a target space 342. In one example, the target space 342 may be an area proximate to a driver's ears, which may be proximate to a driver's seat head rest 346 of a driver seat 347. In FIG. 3, a sensor such as a microphone 344 may be disposed in or adjacent to the head rest 346. The microphone 344 may be connected to the ANC system 300 in a manner similar to that described in regard to FIGS. 1 and 2. In FIG. 3, the ANC system 300 and audio system 310 are connected to the center speaker 338, so that signals generated by the audio system 310 and the ANC system 300 may be combined to drive center speaker 338 and produce a speaker output 350 (represented as dashed arrows). This speaker output 350 may be produced as a sound wave so that the anti-noise destructively interferes with the engine noise 303 in the target space 342. One or more other speakers in the vehicle 302 may be selected to produce a sound wave that includes transmit anti-noise. Furthermore, the microphone 344 may be placed at various positions throughout the vehicle in one or more desired target spaces.

Figure 4:
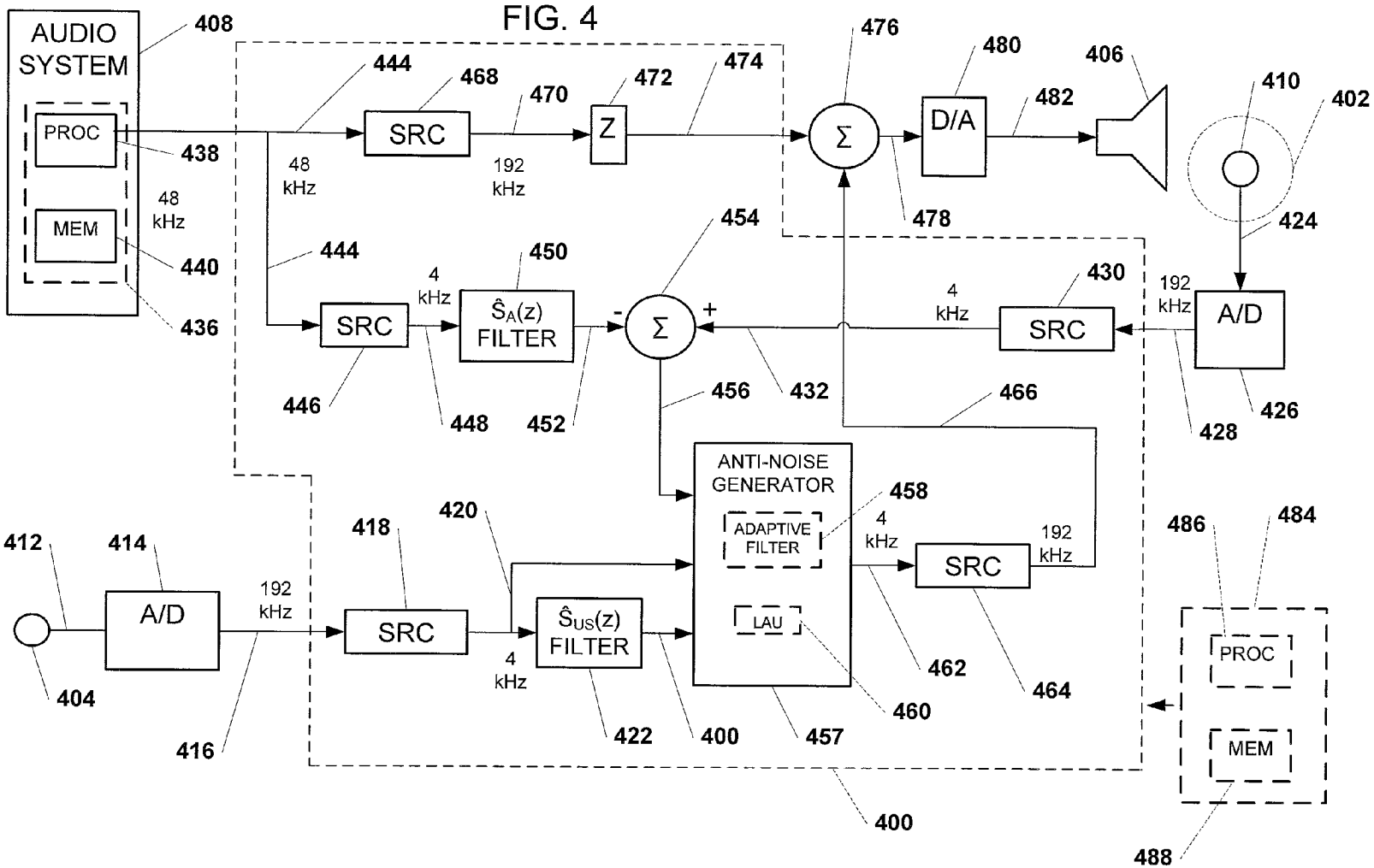
FIG. 4 depicts an example of a system implementing an ANC system.

In FIG. 4, an example of an ANC system 400 with audio compensation is shown as a single-channel implementation. In one example, the ANC system 400 may be used in a vehicle, such as the vehicle 302 of FIG. 3. Similar to that described in regard to FIGS. 1 and 2, the ANC system 400 may be configured to generate anti-noise to eliminate or reduce an undesired noise in a target space 402. The anti-noise may be generated in response to detection of an undesired noise through a sensor 404. The ANC system 400 may generate anti-noise to be transmitted through a speaker 406. The speaker 406 may also transmit an audio signal produced by an audio system 408. A microphone 410 may be positioned in the target space 402 to receive output from the speaker 406. The input signal of the microphone 410 may be compensated for presence of a signal representative of an audio signal generated by the audio system 408. After removal of the signal component, a remaining signal may be used as input to the ANC system 400.

In FIG. 4, the sensor 404 may generate an output 412 received by an A/D converter 414. The A/D converter 414 may digitize the sensor output 412 at a predetermined sample rate. A digitized undesired sound signal 416 of the A/D converter 414 may be provided to a sample rate conversion (SRC) filter 418. The SRC filter 418 may filter the digitized undesired sound signal 416 to adjust the sample rate of the undesired sound signal 416. The SRC filter 418 may output the filtered undesired sound signal 420, which may be provided to the ANC system 400 as an input. The undesired sound signal 420 may also be provided to an undesired sound estimated path filter 422. The estimated path filter 422 may simulate the effect on the undesired sound of traversing from the speaker 406 to the target space 402. The filter 422 is represented as a z-domain transfer function $\hat{S}_{US}(z)$.

As previously discussed, the microphone 410 may detect a sound wave and generate an input signal 424 that includes both an audio signal and any signal remaining from destructive interference between undesired noise and the sound wave output of the speaker 406. The microphone input signal 424 may be digitized through an A/D converter 426 having an output signal 428 at a predetermined sample rate. The digitized microphone input signal 428 may be provided to an SRC filter 430 which may filter the output 428 to change the sample rate. Thus, output signal 432 of the SRC filter 430 may be the filtered microphone input signal 428. The signal 432 may be further processed as described later.

In FIG. 4, the audio system 408 may generate and audio signal 444. The audio system 408 may include a digital signal processor (DSP) 436. The audio system 408 may also include a processor 438 and a memory 440. The audio system 408 may process audio data to provide the audio signal 444. The audio signal 444 may be at a predetermined sample rate. The audio signal 444 may be provided to an SRC filter 446, which may filter the audio signal 444 to produce an output signal 448 that is an adjusted sample rate version of the audio signal 444. The output signal 448 may be filtered by an estimated audio path filter 450, represented by z-domain transfer function $\hat{S}_A(z)$. The filter 450 may simulate the effect on the audio signal 444 transmitted from the audio system 444 through the speaker 406 to the microphone 410. An audio compensation signal 452 represents an estimation of the state of the audio signal 444 after the audio signal 444 traverses a physical path to the microphone 410. The audio compensation signal 452 may be combined at with the microphone input signal 432 at summer 454 to remove a component from the microphone input signal 432 representative of audio signal component 444.

An error signal 456 may represent a signal that is the result of destructive interference between anti-noise and undesired sound in the target space 402 absent the sound waves based on an audio signal. The ANC system 400 may include an anti-noise generator 457 that includes an adaptive filter 458 and an LAU 460, which may be implemented to generate an anti-noise signal 462 in a manner as described in regard to FIG. 2. The anti-noise signal 462 may be generated at a predetermined sample rate. The signal 462 may be provided to an SRC filter 464, which may filter the signal 462 to adjust the sample rate, which may be provided as output signal 466.

The audio signal 444 may also be provided to an SRC filter 468, which may adjust the sample rate of the audio signal 444. Output signal 470 of the SRC filter 468 may represent the audio signal 444 at a different sample rate. The audio signal 470 may be provided to a delay filter 472. The delay filter 472 may be a time delay of the audio signal 470 to allow the ANC system 400 to generate anti-noise such that the audio signal 452 is synchronized with output from the speaker 406 received by the microphone 410. Output signal 474 of the delay filter 472 may be summed with the anti-noise signal 466 at a summer 476. The combined signal 478 may be provided to a digital-to-analog (D/A) converter 480. Output signal 482 of the D/A converter 480 may be provided to the speaker 406, which may include an amplifier (not shown), for production of sound waves that propagate into the target space 402.

In one example, the ANC system 400 may be instructions stored on a memory executable by a processor. For example, the ANC system 400 may be instructions stored on the memory 440 and executed by the processor 438 of the audio system 408.

In another example, the ANC system 400 may be instructions stored on a memory 488 of a computer device 484 and executed by a processor 486 of the computer device 484. In other examples, various features of the ANC system 400 may be stored as instruction on different memories and executed on different processors in whole or in part. The memories 440 and 488 may each be computer-readable storage media or memories, such as a cache, buffer, RAM, removable media, hard drive or other computer readable storage media. Computer readable storage media include various types of volatile and nonvolatile storage media. Various processing techniques may be implemented by the processors 438 and 486 such as multiprocessing, multitasking, parallel processing and the like, for example.

Figure 5:
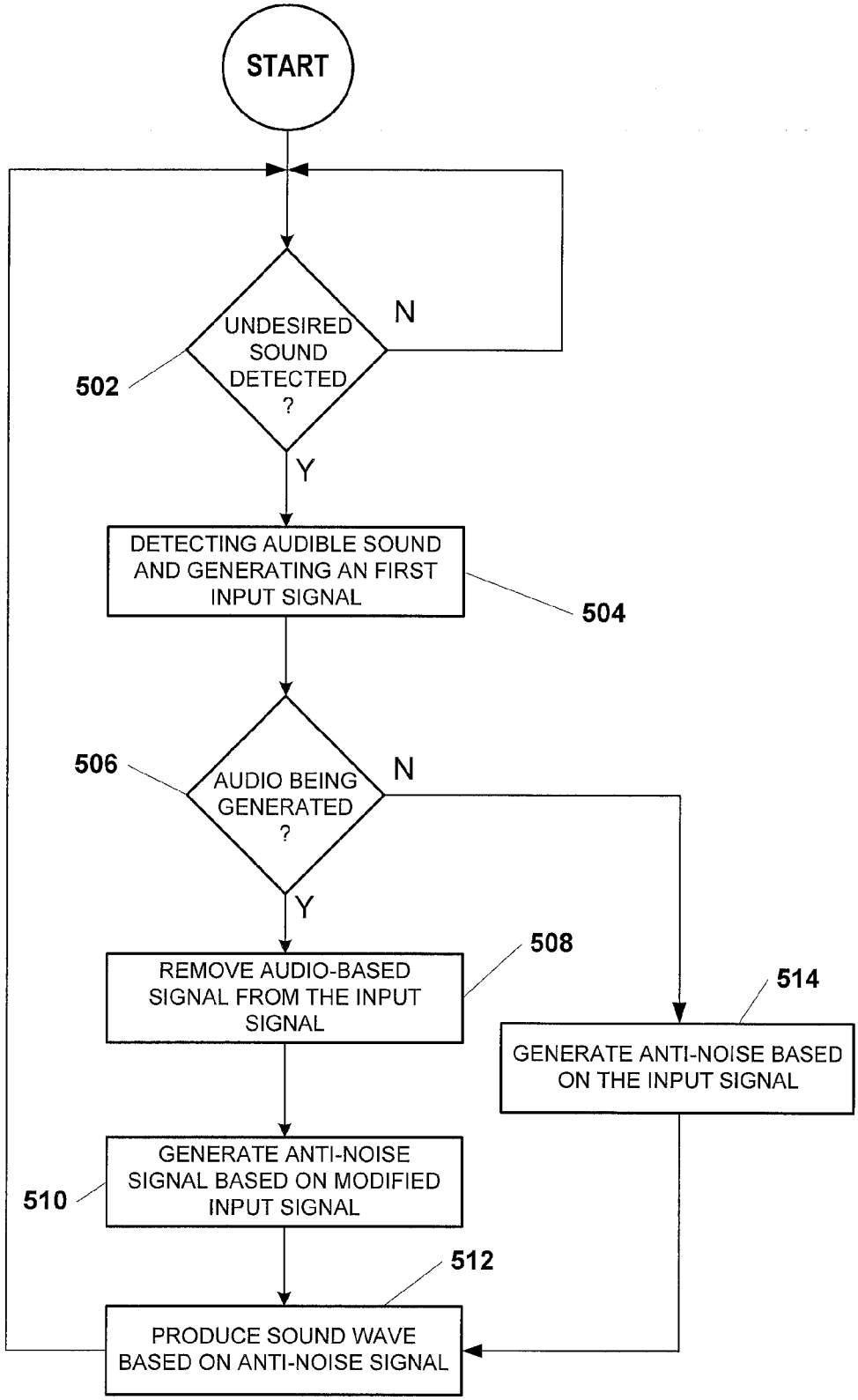
FIG. 5 depicts an example of operation of an ANC system with audio compensation.

In FIG. 5, a flowchart illustrates an example operation of signal processing performed with active noise control in a system such as that shown in FIG. 4. A step 502 of the operation may include determining if an undesired sound is detected. In the example shown in FIG. 5, the step 502 may be performed by the sensor 404, which may be configured to detect a frequency or frequency range encompassing the undesired sound. If the undesired noise is not detected, the step 502 may be performed until detection. If the undesired noise is detected, a step 504 of detecting audible sound and generating an input signal may be performed. In one example, step 504 may be performed by a sensor, such as the microphone 410, which is configured to receive audible sound that may include output from the speaker 406 and generate a microphone input signal, such as the microphone input signal.

The operation may also include a step 506 of determining if an audio signal is currently being generated. If the audio signal is currently being generated, an audio-based signal component may be removed from the microphone input signal at step 508. In one example, step 508 may be performed with a configuration such as that shown in FIG. 4 in which the audio compensation signal 452 is combined from the microphone input signal 432 at the summer 454, which generates the error signal 456.

Once the audio-based signal is removed, a step 510 of generating an anti-noise signal based on the modified microphone input signal may be performed. In one example, step 510 may be performed with the ANC system 400, which may receive an error signal 456 upon which to generate an anti-noise signal 462. The error signal 456 may be based upon the combination of the microphone input signal 432 combined with the audio compensation signal 452.

Upon generation of the anti-noise signal, the operation may include a step 512 of producing a sound wave based on the anti-noise signal and directing the sound wave to a target space. In one example, step 512 may be performed through generation of anti-noise sound waves through a speaker, such as the speaker 406 in FIG. 4. The speaker 406 may be configured to generate sound waves based upon an anti-noise signal 466 and the audio signal 474. The sound waves are propagated towards the target space 402 in order to destructively interfere with an undesired sound or sounds present in the target space 402.

If no audio is being generated as determined by step 506, a step 514 of generating an anti-noise signal based on the input signal may be performed. Upon generation of this anti-noise signal, step 512 may be performed, which produces a sound wave based on the anti-noise signal.

As described in FIG. 4, various signals may be subject to sample rate adjustment. The sample rates may be selected to ensure proper signal manipulation. For example, the undesired noise signal 412 and the microphone input signal 424 may be digitized to a sample rate of 192 kHz by A/D converters 414 and 426, respectively. In one example, the A/D converters 414 and 426 may be the same A/D converter.

Similarly, the audio signal 444 may be at an initial sample rate of 48 kHz. The SRC filter 468 may increase the sample rate of the audio signal 444 to 192 kHz. The anti-noise signal 462 may be generated at 4 kHz from the ANC system 400. The sample rate of the signal 462 may be increased by the SRC filter 464 to a sample rate of 192 kHz. The sample rate conversions allow the audio signal 474 and the anti-noise signal 466 to have the same sample rate when combined at the summer 476.

Sample rates of various signals may also be reduced. For example, the digitized undesired noise signal 416 may be reduced from the 192 kHz example to 4 kHz through the SRC filter 418. As a result, the signals 420 and 424 may both be at a 4 kHz sample rate when received by the ANC system 400.

The audio signal 444 may be reduced from the 48 kHz example sample rate to 4 kHz through the SRC filter 446. The digitized error microphone input signal 428 may be reduced from 192 kHz to 4 kHz by the SRC filter 430. This allows the audio compensation signal 452 and the microphone input signal 432 to be at the same sample rates at the summer 454.

In one example, the increase in the anti-noise sample rate from 4 kHz to 192 kHz by the SRC 464 occurs within predetermined time parameters to ensure the anti-noise is generated in time to reach the target space 402 to cancel the undesired noise for which the anti-noise was generated. Thus, the SRC filter 464 may require various design considerations to be taken into account. For example, undesired noise may be expected to be in a frequency range of 20-500 Hz. Thus, the anti-noise may be generated in a similar range. The SRC filter 464 may be designed with such considerations in mind.

Figure 6:
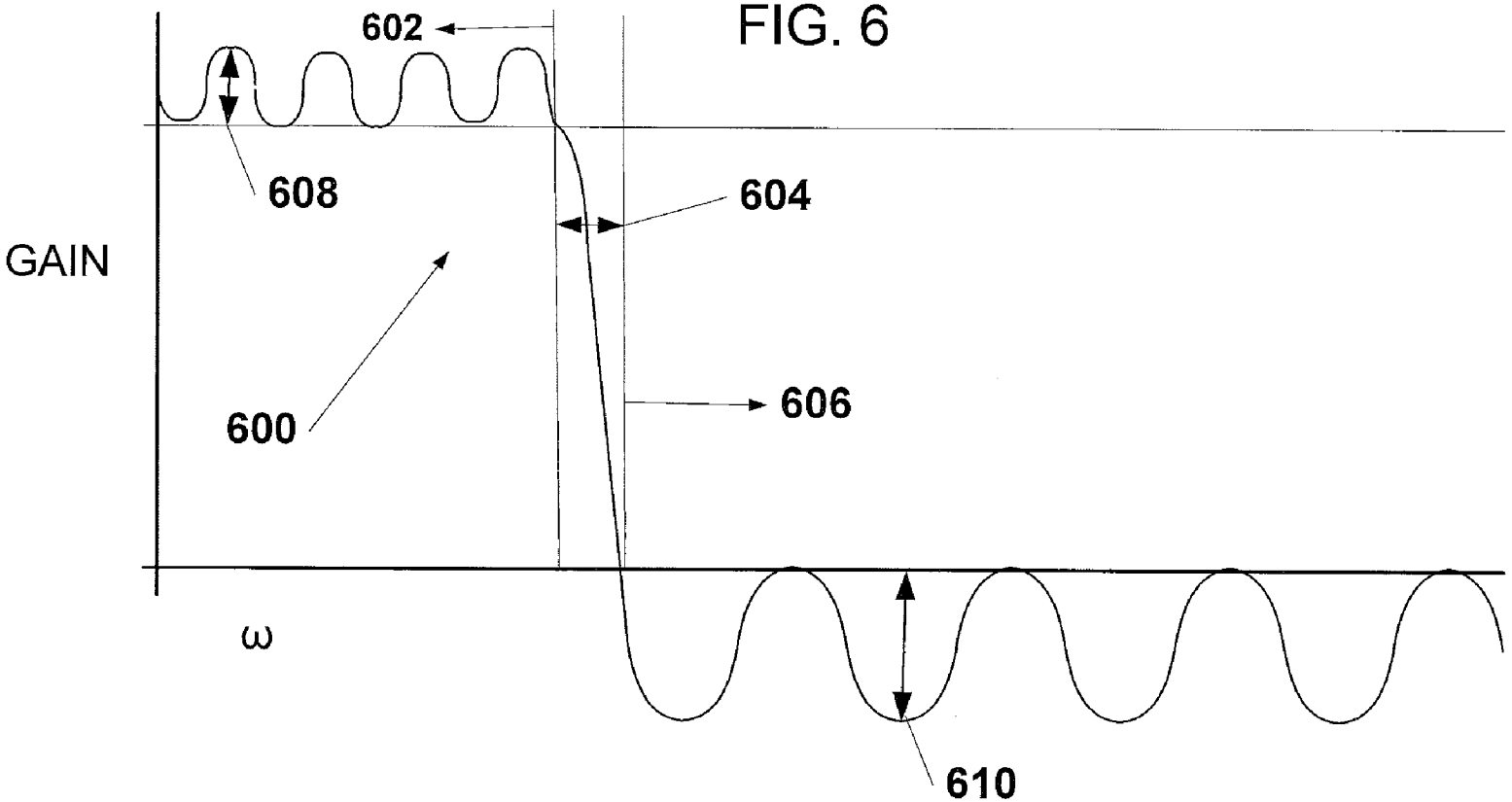
FIG. 6 depicts an example of a frequency versus gain plot for an infinite impulse response (IIR) filter.

Various filter types may be considered in which to implement the SRC filter 464. In one example, the SRC filter 464 may be a finite impulse response (FIR) filter. The FIR filter may be based on an infinite impulse response (IIR) filter, such as an elliptical filter. FIG. 6 shows an example of a waveform 600 of frequency versus gain of an elliptical filter selected upon which to base the SRC filter 464. In one example, gain of an elliptical filter may be defined by:

$$G_n(\omega) = \frac{1}{\sqrt{1 + \varepsilon R_n^2(\xi, \omega/\omega_0)}} \quad \text{(Eq. 1)}$$

where $\epsilon$ is the ripple factor, Rn is nth-order elliptical rational function, $\xi$ is the selectivity factor, $\omega$ is the angular frequency, and $\omega_0$ is the cutoff frequency.

In one example, this equation may be used to design the SRC filter 464. The waveform 600 of FIG. 6 is based on a twenty-first order elliptical filter. An odd order may be selected to ensure that the SRC filter 464 magnitude response is down more than 140 dB at the Nyquist sample rate. In FIG. 6, a passband 602, a transition band 604, and a stopband 606 are indicated. An elliptical filter may also be chosen due to an ability to control the passband ripple 608 and a stopband ripple 610. In one example, the pass band ripple 610 may be approximately 0.01 dB and the stopband attenuation may be approximately 100 dB. In the example shown in FIG. 6, the first deep null of the stopband may be at approximately 0.083 Hz, which may result in a passband cutoff at approximately 0.0816

Figure 7:
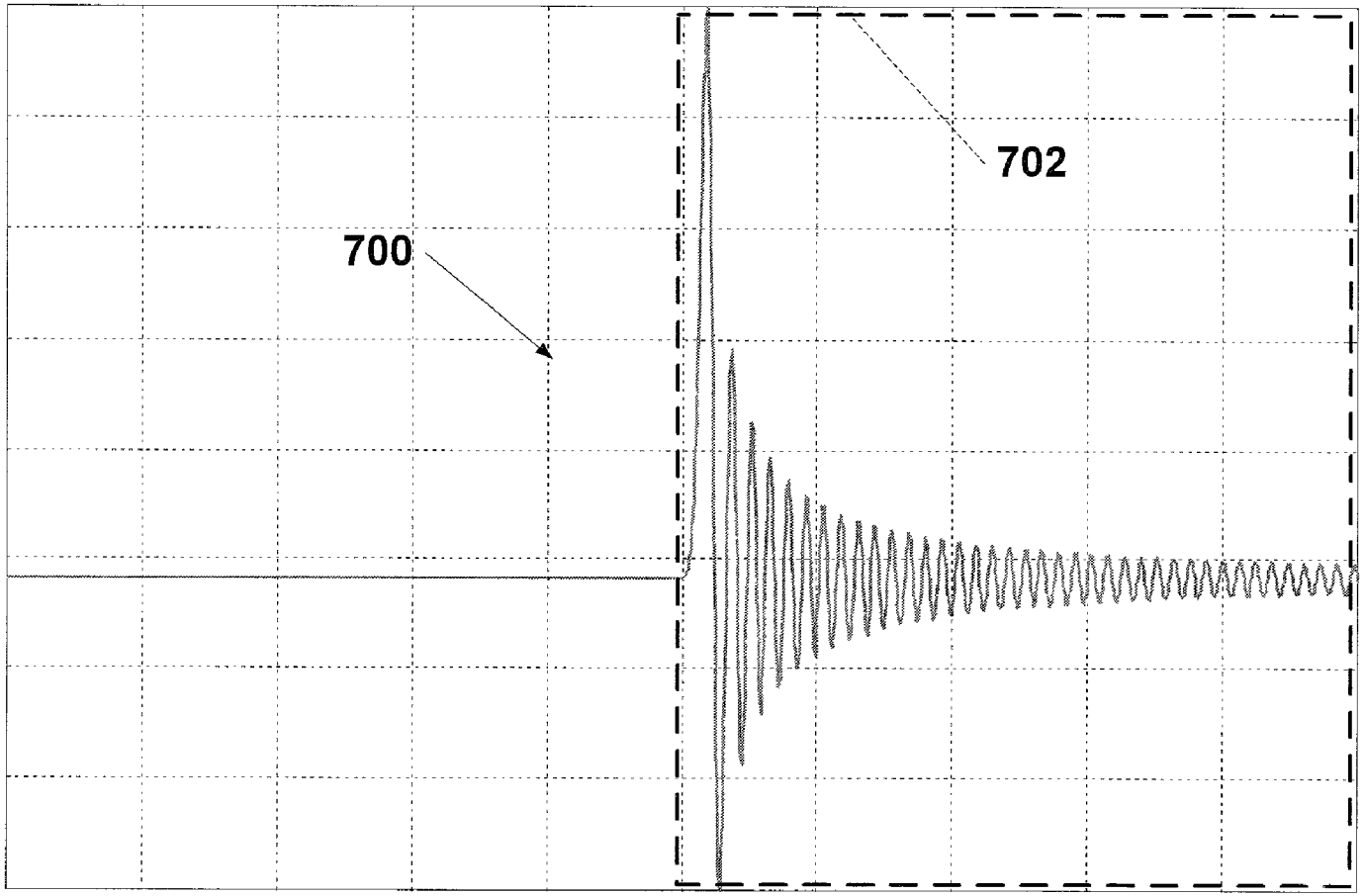
FIG. 7 depicts an example of an impulse response for an IIR filter.

Once the filter is selected, a frequency response may be generated, such as the frequency response in FIG. 7. The waveform 700 shows a digital impulse response of the filter characterized by FIG. 6 generated from filtering an impulse data set of 1024 samples in length containing all zeroes except for zero-based index of 512 set at 1. Upon generation of the number of samples is selected, window 702, such as a Blackman Harris window, may be selected. The size of the window 702 defines the number of samples that are collected. In one example, 1024 samples are selected to be within the window 702. These samples may be collected and incorporated as coefficients in an FIR filter. This FIR filter may then be used as the SRC filter 464. In one example, the increased sample rate performed by the SRC filter 464 may be a multi-stage. For example, in the example of increasing the anti-noise sample rate from 4 kHz to 192 kHz involves an increase of 48 times. The increase may be done in two smaller increases of six and then eight resulting in a increased sample rate of 192 kHz.

Figure 8:
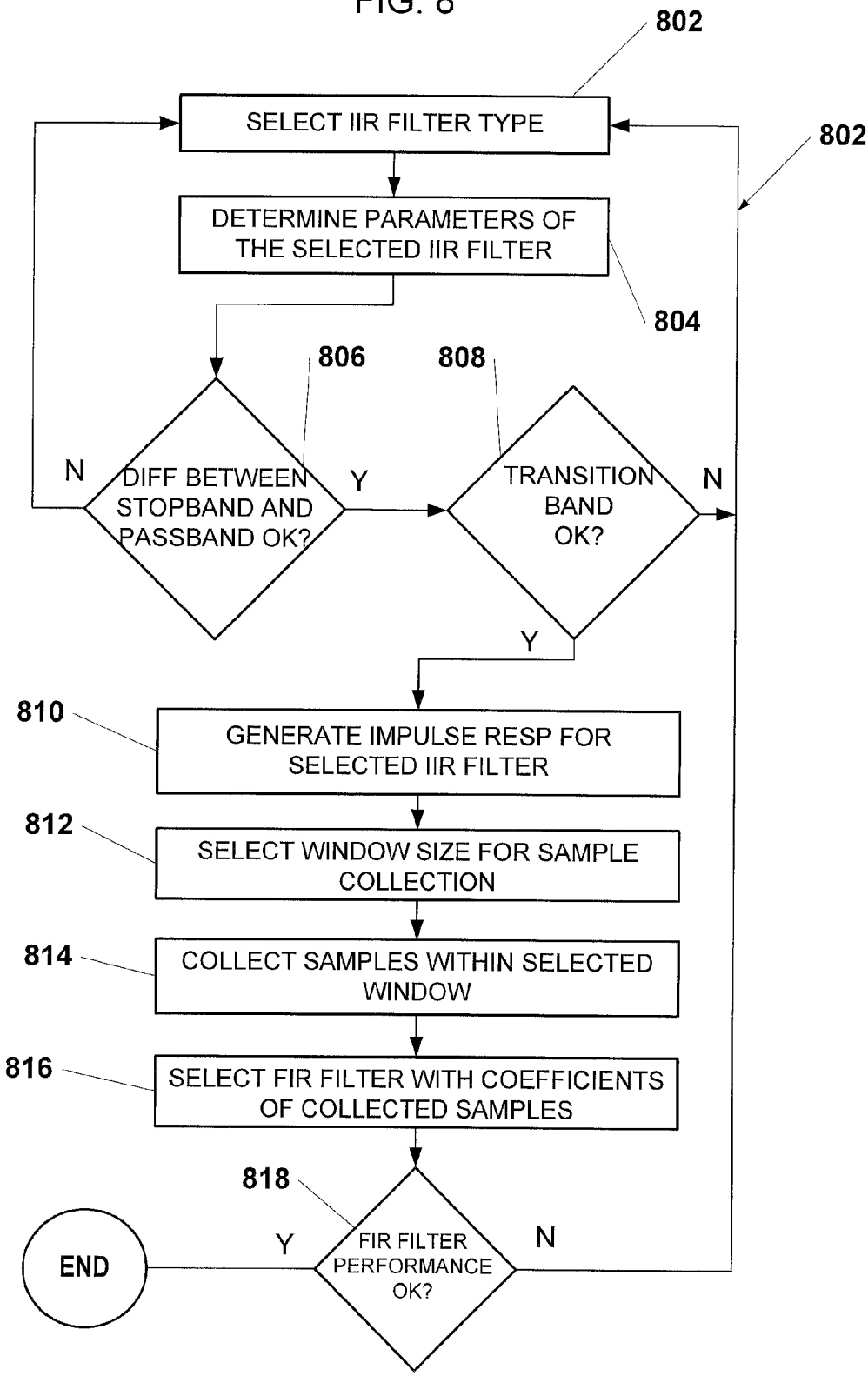
FIG. 8 depicts an example of an operation of generating a finite impulse response (FIR) filter.

FIG. 8 shows a flowchart of an example operation of designing a filter that may be used as the SRC filter 464. A step 802 of selecting an IIR filter type may be performed. Various filters may be selected, such as an elliptical, butterworth, Chebychev, or any other suitable IIR filter. Upon selection of the IIR filter, a step 804 of determining parameters of the selected IIR filter may be performed. Step 804 may be performed through comparison of filter design equations and desired results, such as a gain equation of an elliptical filter in comparison to which frequencies are relevant during filter operation.

Upon selection of the parameters, a step 806 of determining if a difference between a passband and a stopband is within operation constraints may be performed. If the difference is outside of operating constraints, reselection of filter type may occur at step 802. If the difference is acceptable, a step 808 of determining if a transition band is within operating constraints may be performed. A relatively steep transition band may be desired such as in the design of the SRC filter 464. If the transition band is outside operating constraints reselection of IIR filter type may occur at step 802.

If the transition band is acceptable, a step 810 of generating an impulse response for the selected IIR filter may be performed. Generation of the impulse response may create a waveform such as that shown in FIG. 7. Upon generation of the impulse response, a step 812 of selecting a window size for sample collection, such as the window 702 of FIG. 7, may be performed. Upon selection of the window, the operation may include a step 814 of collecting samples within the selected window, such as that described in regard to FIG. 7, for example. Upon collecting the samples, the operation may include a step 816 of selecting an FIR filter with coefficients of the collected samples. Upon selection of the FIR filter, the operation may include a step 818 of determining if the FIR filter performs as expected. If the filter does not perform adequately, reselection of an IIR filter may occur at the step 802.

Figure 9:
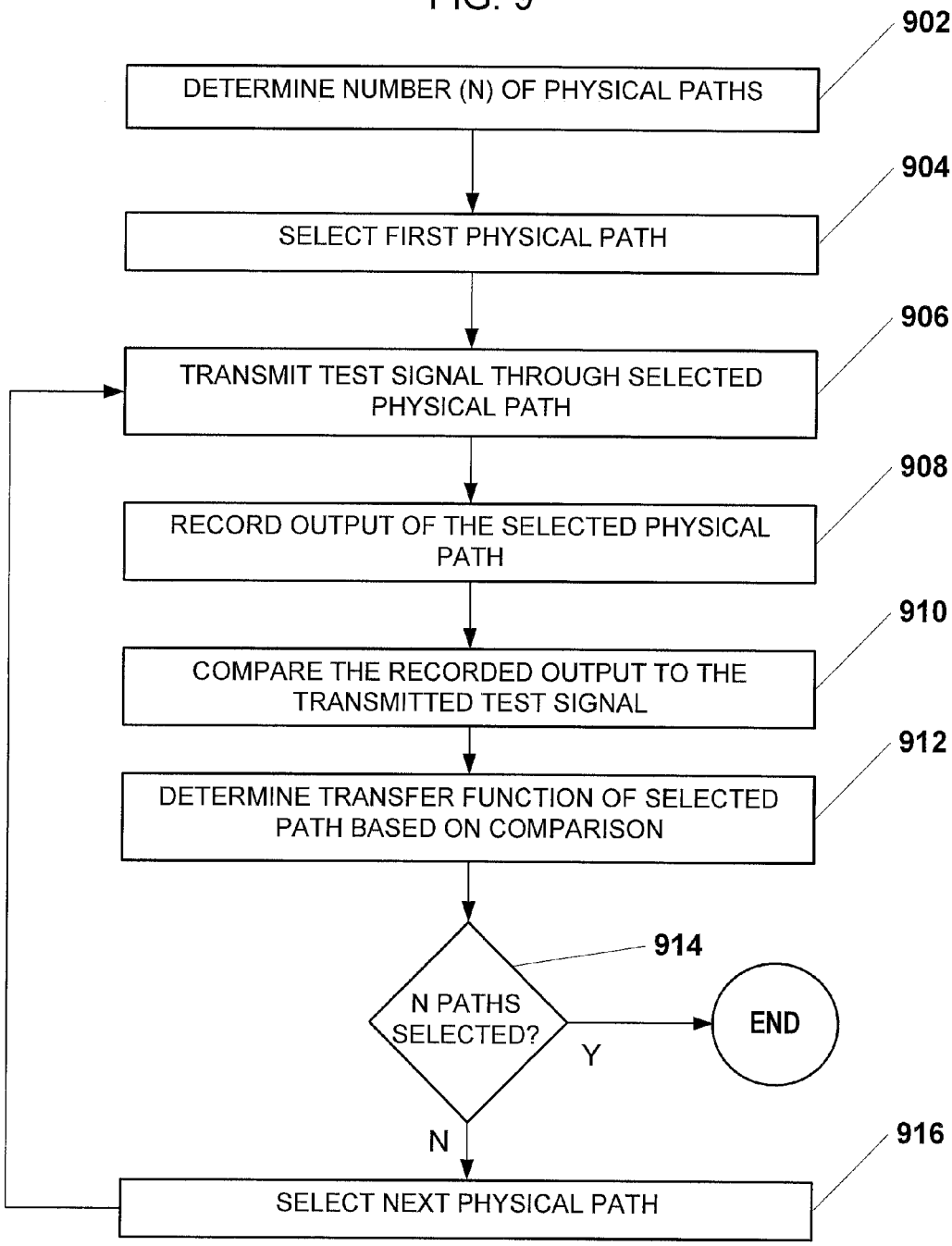
FIG. 9 depicts an example of an operation of generating a plurality of estimated path filters.

As described in FIG. 4, the estimated path filters 422 and 450 may be different transfer functions when undesired sound and audio signals traverse different paths due to being processed by different components and/or arising from different sources. For example, in FIG. 3, audio signals are generated by the audio system 310, which traverse electronic components, as well as the interior of the vehicle 302 when generated as sound waves from the center speaker 338 to the microphone 344. To determine the estimated paths filter transfer functions, a training method may be implemented. FIG. 9 depicts a flowchart of an example operation of determining estimated path filters. The operation may include a step 902 of determining a number of physical paths (N). The number of paths N may determine the number of estimated path filters used within an ANC system. For example, the single-channel configuration of FIG. 4 may implement two estimated path filters 422 and 450. In multi-channel configurations other quantities of estimated path filters may be used such as in the multi-channel configuration shown in FIG. 10.

Once the number N of physical paths is determined at step 902, a step 904 of selecting a first physical path may be performed. The method may include a step 906 of transmitting a test signal through the selected physical path. In one example, Gaussian or "white" noise may be transmitted through a system configured for ANC. Other suitable test signals may be used. For example, in FIG. 4, a test signal may be transmitted such that it traverses a path of an ANC system 400 and is generated as sound waves through the speaker 406 and detected by the microphone 410. Thus, the test signal traverses the electronic components, as well as physical space between the speaker 406 and the microphone 410.

A step 908 of recording an output that traverses the selected physical path may be performed. This output may be used in a step 910 of the method to compare the recorded output to the transmitted test signal. Returning to the example of the configuration shown in FIG. 4, the error signal 456 generated in response to a white noise input may be compared to the white noise input signal. Once the comparison of the step 910 is performed, the method 900 may include a step 912 of determining a transfer function of the selected path based on the comparison between the recorded output signal and the test signal. For example, the white noise input signal may be compared to the signal 432 to determine the transfer function, which provides the relationship between an undesired noise and the processed microphone input signal 432. This allows the filter 422 to be configured such that it simulates the effect on the undesired noise of traversing a physical path to allow the ANC system to generate anti-noise that more closely resembles a phase-shifted version of the undesired sound or sounds experienced by a listener in the target space 402.

A step 914 of determining if N paths have been selected may be performed. Once all N physical paths have been selected and transfer functions determined, the operation may end. However, if N paths have not been selected, a step 916 of selecting a next physical path may be performed. Upon selection of the next physical path, the step 906 may be performed, which allows a test signal to be transmitted through the next selected physical path. For example, in FIG. 4, the next physical path may be the physical path traversed by the audio signal 444 as it traverses components, experiences sample rate conversions, and traverses the distance between the speaker and the microphone 410. Transfer functions for all N physical paths may be determined.

Figure 10:
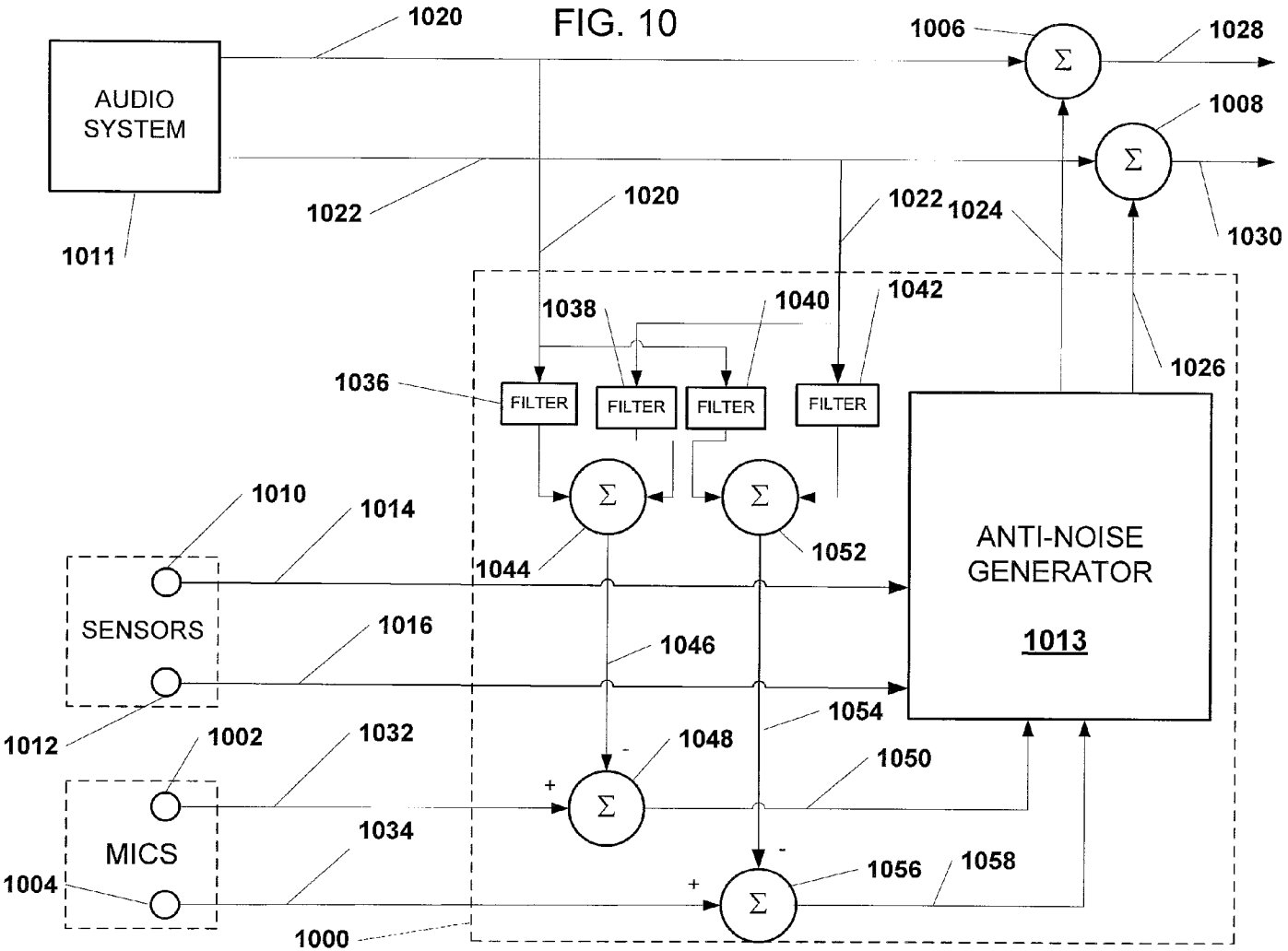
FIG. 10 depicts an example of a multi-channel implementation of an ANC system.

FIG. 10 shows a block diagram of an ANC system 1000 that may be configured for a multi-channel system. The multi-channel system may allow for a plurality of microphones and speakers to be used to provide anti-noise to a target space or spaces. As the number of microphones and speakers increase, the number of physical paths and corresponding estimated path filters grows exponentially. For example, FIG. 10 shows an example of an ANC system 1000 configured to be used with two microphones 1002 and 1004 and two speakers 1006 and 1008 (illustrated as summation operations), as well as two reference sensors 1010 and 1012. The reference sensors 1010 and 1012 may be configured to each detect an undesired sound, which may be two different sounds or the same sound. Each of the reference sensors 1010 and 1012 may generate a signal 1014 and 1016, respectively, indicative of the undesired sound detected. Each of the signals 1014 and 1016 may be transmitted to an anti-noise generator 1013 of the ANC system 1000 to be used as inputs by the ANC system 1000 to generate anti-noise.

An audio system 1011 may be configured to generate a first channel signal 1020 and a second channel signal 1022. In other examples, any other number of separate and independent channels, such as five, six, or seven channels, may be generated by the audio system 1011. The first channel signal 1020 may be provided to the speaker 1006 and the second channel signal 1022 may be provided to speaker 1008. The anti-noise generator 1013 may generate signals 1024 and 1026. The signal 1024 may be combined with the first channel signal 1020 so that both signals 1020 and 1024 are transmitted as speaker output 1028 of the speaker 1006. Similarly, the signals 1022 and 1026 may be combined so that both signals 1022 and 1026 may be transmitted as speaker output 1030 from the speaker 1008. In other examples, only one anti-noise signal may be transmitted to one or both speakers 1006 or 1008.

Microphones 1002 and 1004 may receive sound waves that include the sound waves output as speaker outputs 1028 and 1030. The microphones 1002 and 1004 may each generate a microphone input signal 1032 and 1034, respectively. The microphone input signals 1032 and 1034 may each indicate sound received by a respective microphone 1002 and 1004, which may include an undesired sound and the audio signals. As described, a component representative of an audio signal may be removed from a microphone input signal. In FIG. 10, each microphone 1002 and 1004 may receive speaker outputs 1028 and 1030, as well as any targeted undesired sounds. Thus, components representative of the audio signals associated with each of the speaker outputs 1028 and 1030 may be removed from the each of the microphone input signals 1032 and 1034.

In FIG. 10, each audio signal 1020 and 1022 is filtered by two estimated path filters. Audio signal 1020 may be filtered by estimated path filter 1036, which may represent the estimated physical path (including components, physical space, and signal processing) of the audio signal 1020 from the audio system 1011 to the microphone 1002. Audio signal 1022 may be filtered by estimated path filter 1038, which may represent the estimated physical path of the audio signal 1022 from the audio system 1011 to the microphone 1002. The filtered signals may be summed at summation operation 1044 to form combined audio signal 1046. The signal 1046 may be used to eliminate a similar signal component present in the microphone input signal 1032 at operation 1048. The resulting signal is an error signal 1050, which may be provided to the ANC system 1000 to generate anti-noise 1024 associated with an undesired sound detected by the sensor 1010.

Similarly the audio signals 1020 and 1022 may be filtered by estimated paths 1040 and 1042, respectively. Estimated path filter 1040 may represent the physical path traversed by the audio signal 1020 from the audio system 1011 to the error microphone 1004. Estimated path filter 1042 represents the physical path traversed by the audio signal 1022 from the audio system 1011 to the microphone 1004. The audio signals 1020 and 1022 may be summed together at summation operation 1052 to form a combined audio signal 1054. The audio signal 1054 may be used to remove a similar signal component present in the microphone input signal 1034 at operation 1056, which results in an error signal 1058. The error signal 1058 may be provided to the ANC system 1000 to generate an anti-noise signal 1026 associated with an undesired sound detected by the sensor 1004.

The estimated path filters 1036, 1038, 1040, and 1042 may be determined in a manner such as that described in regard to FIG. 9. As reference sensors and microphones increase in number other estimated path filters may be implemented in order to eliminate audio signals from microphone input signals to generate error signals that allow the ANC system to generate sound cancellation signals based on the error signals to destructively interfere with one or more undesired sounds.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A sound reduction system comprising:

a processor; and an active noise control system executable by the processor, the active noise control system configured to:

filter a first audio channel signal with a first estimated path filter, the first estimated path filter representative of a first physical path traversed by the first audio channel signal;

filter a second audio channel signal with a second estimated path filter, the second estimated path filter representative of a second physical path traversed by the second audio channel signal that is different from the first physical path;

combine the first audio channel filtered with the first estimated path filter and the second audio channel filtered with the second estimated path filter to form a combined audio channel signal; and generate an error signal used in generation of an anti-noise signal, the error signal generated based on the combined audio channel signal and a microphone input signal representative of audible sound at a target space.

2. The system of claim 1, where the active noise control system is further executable by the processor to combine the anti-noise signal with one of the first audio channel signal or the second audio channel signal to generate a speaker output signal used to drive a loudspeaker adjacent the target space.

3. The system of claim 1, where the active noise control system is further executable by the processor to remove a portion of the microphone input signal corresponding to the combined audio channel signal to generate the error signal.

4. The system of claim 1, where each of the first and second audio channel signals are separate audio channel signals representative of a respective audio channel used to drive a corresponding one of a plurality of respective loudspeakers, and the first physical path includes representation of a first one of the plurality of respective loudspeakers, and the second physical path includes representation of a second one of the plurality of respective loudspeakers.

5. The system of claim 1, where the active noise control system is further executable by the processor to receive the microphone input signal from a microphone positioned in the target space.

6. The system of claim 1, where the first and second audio channel signals are each used to drive a corresponding one of a plurality of respective loudspeakers, and the microphone input signal includes a component representative of audible sound from the first audio channel signal driving a first one of the plurality of respective loudspeakers, and the second audio channel signal driving a second one of the plurality of respective loudspeakers.

7. The system of claim 1, where the active noise control system is further executable by the processor to receive an undesired sound signal, the anti-noise signal generated based on the undesired sound signal and the error signal.

8. A sound reduction system comprising:

an active noise control system that includes a plurality of estimated path filters;

the active noise control system configured to receive a plurality of separate audio channel signals from an audio system, the audio channel signals including a first audio channel signal and a second audio signal;

the active noise control system further configured to apply a corresponding first one of the plurality of estimated path filters to the first audio channel signal and a second one of the plurality of estimated path filters to the second audio channel signal to generate different respective filtered audio channel signals;

the active noise control system further configured to combine the different respective filtered audio channel signals to generate a combined filtered audio channel signal; and the active noise control system further configured to generate an anti-noise signal for combination with one of the first audio channel signal or the second audio channel signal to drive a loudspeaker, the anti-noise signal generated using the combined filtered audio channel signal.

9. The system of claim 8, where the active noise control system is further configured to receive a microphone signal representative of audible sound in a target space, and to remove a component from the microphone signal using the combined filtered audio channel signal to generate an error signal, the error signal used to generate the anti-noise signal.

10. The system of claim 9, where the component is representative of audible sound produced at the target space with the first audio channel signal and the second audio channel signal.

11. The system of claim 9, where the active noise control system is further configured to receive an undesired sound signal representative of an undesired sound detected with a sensor, and to generate the anti-noise signal using the undesired sound signal and the error signal.

12. The system of claim 8, where the loudspeaker is a first corresponding loudspeaker, the different respective filtered audio channel signals are first different respective filtered audio channel signals, the anti-noise signal is a first anti-noise signal, and the second audio channel signal is used to drive a corresponding second loudspeaker, and the active noise control system is further configured to apply a corresponding third one of the plurality of estimated path filters to the first audio channel signal and a fourth one of the plurality of estimated path filters to the second audio channel signal to generate second different respective filtered audio channel signals, the active noise control system further configured to generate a second anti-noise signal for combination with the second audio channel signal to drive the second corresponding loudspeaker, the second anti-noise signal generated using the second combined filtered audio channel signal.

13. The system of claim 8, where the plurality of estimated path filters include at least two different estimated path filters corresponding to each of the separate audio channel signals.

14. The system of claim 13, where each of the estimated path filters are representative of a different physical path within the active noise control system.

15. A sound reduction system comprising:

an active noise control system configured to receive a plurality of separate and independent audio channel signals from an audio system;

the active noise control system further configured to provide a plurality of speaker outputs to drive a plurality of respective loudspeakers;

the active noise control system including a plurality of estimated path filters, each corresponding to at least a portion of an estimated physical path that includes representation of a physical path traversed by sound waves output by respective loudspeakers;

the active noise control system further configured to independently apply at least two different estimated path filters to each of the respective audio channel signals to generate multiple filtered audio channel signals for each of the respective audio channel signals; and the active noise control system further configured to generate an anti-noise signal from the multiple filtered audio channel signals.

16. The system of claim 15, where the active noise control system is further configured to combine the anti-noise signal with a corresponding one of the respective audio channel signals received from the audio system to form the speaker outputs.

17. The system of claim 15, where the active noise control system is configured to combine one of the multiple filtered audio channel signals from a first respective audio channel with one of the multiple filtered audio channel signals from a second respective audio channel to generate a combined filtered audio channel signal, the combined filtered audio channel signal used to generate an error signal to dynamically adjust the anti-noise signal.

18. The system of claim 17, where the active noise control system is further configured to combine the combined filtered audio channel signal with a microphone input signal to remove a component from the microphone input signal representative of the first and second respective audio channels and generate the error signal, the microphone input signal received by the active noise control system.

19. The system of claim 17, where the active noise control system is configured to receive an undesired noise signal provided from a sensor, the active noise control system further configured to dynamically adjust the anti-noise signal based on the undesired noise signal and the error signal.

20. The system of claim 15, where each of the plurality of estimated path filters represents a different estimated physical path that includes physical space and signal processing by the active noise control system.

* * * * *

UNITED STATES PATENT AND TRADEMARK OFFICE

CERTIFICATE OF CORRECTION

PATENT NO. : 8,270,626 B2
APPLICATION NO. : 13/419420
DATED : September 18, 2012
INVENTOR(S) : Shridhar et al.

It is certified that error appears in the above-identified patent and that said Letters Patent is hereby corrected as shown below:

On the Title Page:

Under Related U.S. Application Data Item (63)

Line 4, please delete "Mar. 12, 2010" and insert --Mar. 12, 2012--.

Signed and Sealed this
Thirtieth Day of April, 2013

Teresa Stanek Rea
*Acting Director of the United States Patent and Trademark Office*